US007333621B2

(12) United States Patent
Lun

(10) Patent No.: US 7,333,621 B2
(45) Date of Patent: Feb. 19, 2008

(54) CONDUCTIVE STUB OF SOUND EXCITER

(75) Inventor: Yao Tsun Lun, Taoyuan (TW)

(73) Assignee: Ariose Electronics Co., Ltd., Taoyuan (TW)

( * ) Notice: Subject to any disclaimer, the term of this patent is extended or adjusted under 35 U.S.C. 154(b) by 937 days.

(21) Appl. No.: 10/673,299

(22) Filed: Sep. 25, 2003

(65) Prior Publication Data

US 2005/0069157 A1 Mar. 31, 2005

(51) Int. Cl.
*H04R 25/00* (2006.01)

(52) U.S. Cl. ..... 381/190; 381/186

(58) Field of Classification Search ..... 381/152, 381/190, 186, 386; 310/322, 324, 326, 354; 181/150, 157, 161, 173
See application file for complete search history.

(56) References Cited

U.S. PATENT DOCUMENTS 4,947,075 A * 8/1990 Maury et al. ..... 310/324

7,149,318 B2 * 12/2006 Bank et al. ..... 381/190

* cited by examiner

*Primary Examiner*—Brian Ensey

(57) ABSTRACT

A conductive stub of a sound exciter comprises an insulating stub and at least two beams. Each beam has a positive electrode surface and a negative electrode surface. The stub is connected with a positive electrode lead and a negative electrode lead serves for being connected to an external sound source. A positive electrode conductive element and a negative electrode conductive element are embedded in the stub. Each of the positive electrode conductive element and the negative electrode conductive element has an external joint for connecting touch press ends. The touch press ends of the positive and negative electrode conductive elements are in contact with a positive and a negative electrode surface, respectively, of each beam. By above mentioned components, sound signals are transferred to each beam to excite the beams to oscillate and then emits sound.

9 Claims, 4 Drawing Sheets

CONDUCTIVE STUB OF SOUND EXCITER

BACKGROUND OF THE INVENTION

1. Field of the Invention

The present invention relates to conductive stubs of sound exciters, and particularly to a conductive stub of a sound exciter with piezoelectric beams. Positive and negative electrode conductive elements are mounted within the stub. The elements are in contact with positive and negative electrode surfaces of the beams.

2. Description of the Related Art

The sound exciter is a device for exciting sound signals from sound lines. Currently, the sound exciter is used to replace conventional sound device. Moreover, the sound exciter is compact so as to be used in various computers or peripherals of the computers, TVs, telephones, wireless Audio, communication devices, electronic toys, ATMs, or there audio devices, tools, or substrates.

In one prior art, technology using sound exciter is disclosed. In this prior art, a substrate 1 for emitting sound is firmly secured with a rod stub 11 (referring to FIG. 1). At least one beam 12 is mounted on the stub 11. Each beam 12 is made of piezoelectric material and the upper surface 121 and lower surface 122 of each beam 12 are connected to the positive electrode lead 13 and negative electrode lead 14 of a sound source so that the beams oscillate to emit sound.

In above mentioned prior art, the positive electrode lead 13 and negative electrode lead 14 of the beams 12 are soldered to the upper and lower surfaces 121, 122 of each beam 12 ,so that the working process is complicated due to the welding process, and moreover, the joints 15, 16 of the leads with soldering tin are exposed out. Thereby, the leads are easy to pull so as to become loose or the leads are worn out due to oxidization. Furthermore, the distances between the two beams is too narrow so that when the beams 12 oscillate, the joints 15, 16 of adjacent surfaces 121, 122 would contact with each other to make short-circuit. Further, the leads 13, 14 will interfere sound waves generated from the oscillation of the beams so that the sound is unclear.

The prior art sound exciter is not perfect. Thereby, there is an eager demand for a novel design which can improve above said defects in the prior art.

SUMMARY OF THE INVENTION

Accordingly, the primary object of the present invention is to provide a conductive stub of a sound exciter wherein the piezoelectric beams and the touch press ends of the conductive elements are embedded in an insulating stub so as to enhance the fixedness of the package of the conductive structure and the working process is simplified.

Another object of the present invention is to provide a conductive stub of a sound exciter, wherein leads for transferring sound signals are embedded in an insulated stub with conductive elements and beams therein so that the package for conduction connection of the sound signals are firmly secured.

A further object of the present invention is to provide a conductive stub of a sound exciter, wherein the touch press ends of the conductive elements are packaged in a middle section of the piezoelectric beams so that two wing portions of the beams expose out without using any soldering leads to decrease the efficiency of sound emission when the beams oscillate.

A further object of the present invention is to provide a conductive stub of a sound exciter, wherein the driving circuit used for the sound exciter is made as a dice, the dice is mounted on the stub; and the driving circuit is formed by an Integrated Circuit containing a DC-DC converter and an amplifier.

To achieve above objects, the present invention provides a conductive stub of a sound exciter comprises an insulating stub and at least two beams. The stub is connected with an positive electrode lead and a negative electrode lead serves for being connected to an external sound source. A positive electrode conductive element and a negative electrode conductive element being embedded in the stub. Each of the positive electrode conductive element and the negative electrode conductive element has, an external joint for connecting touch press ends. The touch press ends of the positive and negative electrode conductive elements are in contact with a positive and a negative electrode surface, respectively, of each beam. By above mentioned components, sound signals are transferred to each beam to excite the beams to oscillate and then emits sound.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described as the following in details. However, these descriptions and the appended drawings are only used to cause those skilled in the art to understand the objects, features, and characteristics of the present invention, but not to be used to confine the scope and spirit of the present invention defined in the appended claims.

Figure 1:
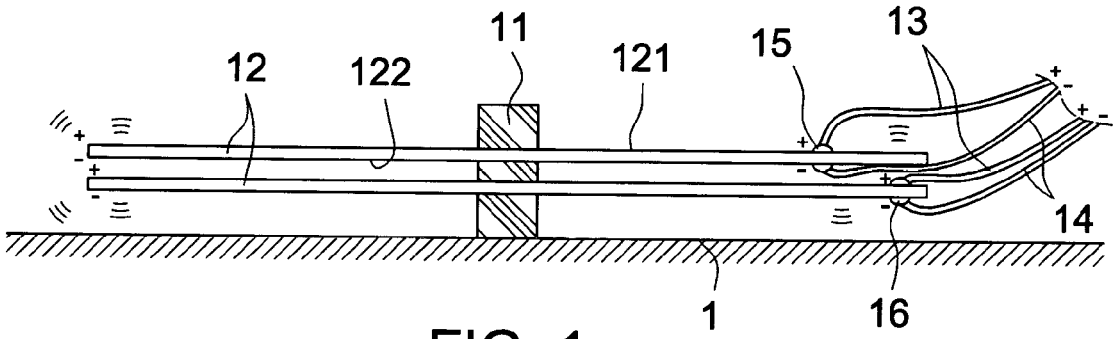
FIG. 1 (Prior Art)
FIG. 1 is a cross sectional view of a prior art sound exciter.
Figure 2:
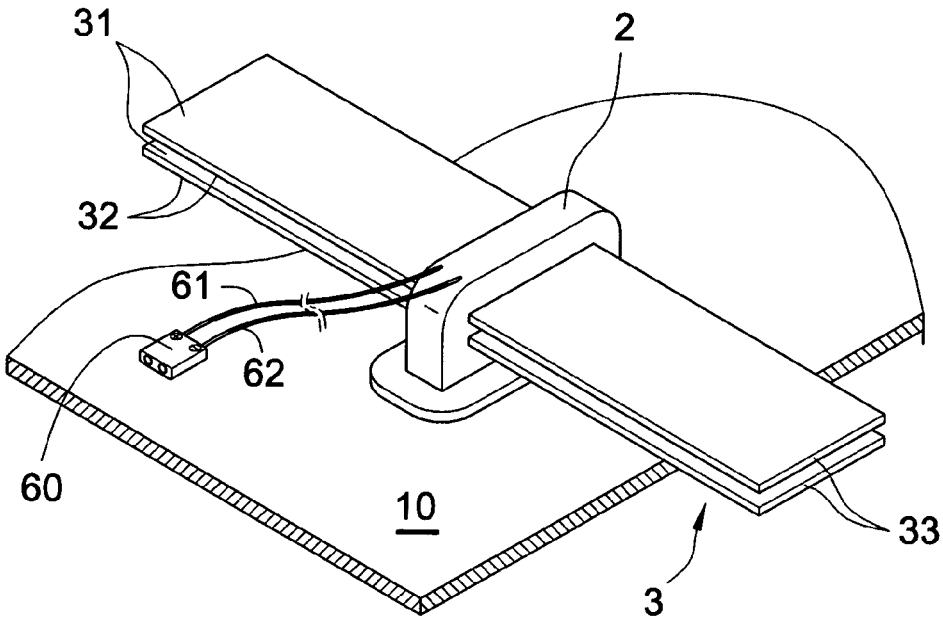
FIG. 2 is a perspective view of the sound exciter of the present invention.

Referring to FIG. 2, a perspective view of the structure of the present invention is illustrated. It is illustrated that a stub 2 is installed on a substrate 10 of an object. The object can one of computers or peripherals of the computers, TVs, telephones, wireless Audio, communication devices, electronic toys, ATMs, or there audio-devices, tools, etc. The stub 2 is made of an insulated material which can be shaped by packaging, such as Acrylonitrile Butadiene Styrene (simply called as ABS) or other plastic material.

FIG. 2 shows the two thin piezoelectric beams 3 are installed on the stub 2. The two beams 3 are arranged in parallel or stack direction. Each beam 3 is made of piezoelectric material so that each beam 3 is formed with electrodes 33 which include a positive electrode surface 31 and a negative electrode surface 32.

Figure 3:
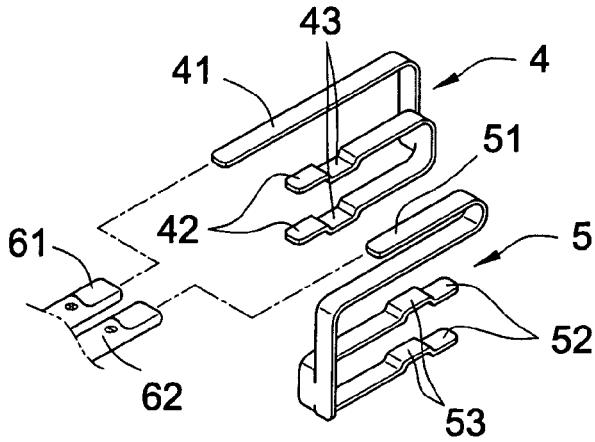
FIG. 3 is a schematic perspective view of the conductive elements according to the present invention.
Figure 4:
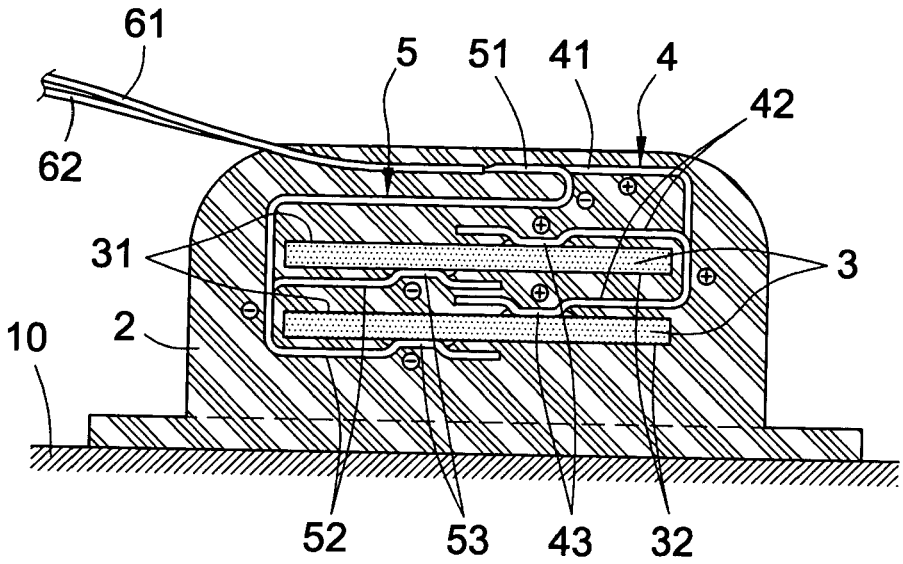
FIG. 4 is a cross sectional view of the sound exciter of the present invention.

A positive electrode conductive element 4 and a negative electrode conductive element 5 is embedded in the insulating stub 2 (referring to FIG. 4). The positive electrode conductive element 4 and the negative electrode conductive element 5 are made of copper or other conductive metal. The positive electrode conductive element 4 is integrally formed with an external joint 41 and two touch press ends 42 and the negative electrode conductive element 5 is integrally formed with an external joint 51 and two touch press ends 52. The touch press ends 42, 52 are in contact with the beams 3 (referring to FIG. 3).

The external joints 41, 51 are connected to the positive electrode lead 61 and the negative electrode lead 62, respectively (referring to FIG. 3) so that the positive electrode lead 61 is connected to the external joint 41 of the positive electrode conductive element 4 and the negative electrode lead 62 is connected to the external joint 51 of the negative electrode conductive element 5. The connecting ends of the positive electrode lead 61 and the negative electrode lead 62, the positive electrode conductive element 4 and negative electrode conductive element 5, and the two beams 3 are packaged in the stub 2 to be as an integral body (referring to FIG. 4) so that the conductive package for transferring sound voice is firmly secured.

Another ends of the positive electrode lead 61 and negative electrode lead 62 are connected to a connector 60 with positive and negative electrode inserting holes or pins (referring to FIG. 2) for being connected with the leads of sound source of an external device.

The touch press end 42 of the positive electrode conductive element 4 can be formed with a touch press portion 43 having a protruded cambered shape or as a tip portion so that the touch press end 42 or the touch press portion 43 is directly mounted to the positive electrode surface 31 of the beam 3. Thus, the positive electrode sound source can be transferred to the positive electrode surface 31 of the beam 3 to be as a positive voltage loop (referring to FIG. 4).

The touch press end 52 of the negative electrode conductive element 5 can be formed with a touch press, portion 53 so that the touch press end 52 or the touch press portion 53 are directly mounted to the negative electrode surface 32 of t he beam 3 so that the negative electrode sound source can be transferred to the negative electrode surface 32 of the beam 3 to be as a negative voltage loop (referring to FIG. 4).

By above mentioned components, when the sound signals in a device are transferred to the positive electrode surface 31 and the negative electrode surface 32 of the beams 3 through the positive electrode lead 61, negative electrode lead 62, positive electrode conductive element 4, and negative electrode conductive element 5 in the stub 2, the wings at two sides of each beam 3 are exposed out (referring to FIG. 2) without soldering wires. Thereby, the beams 3 are excited so that the substrate 10 oscillates to emit clear voice.

Figure 5:
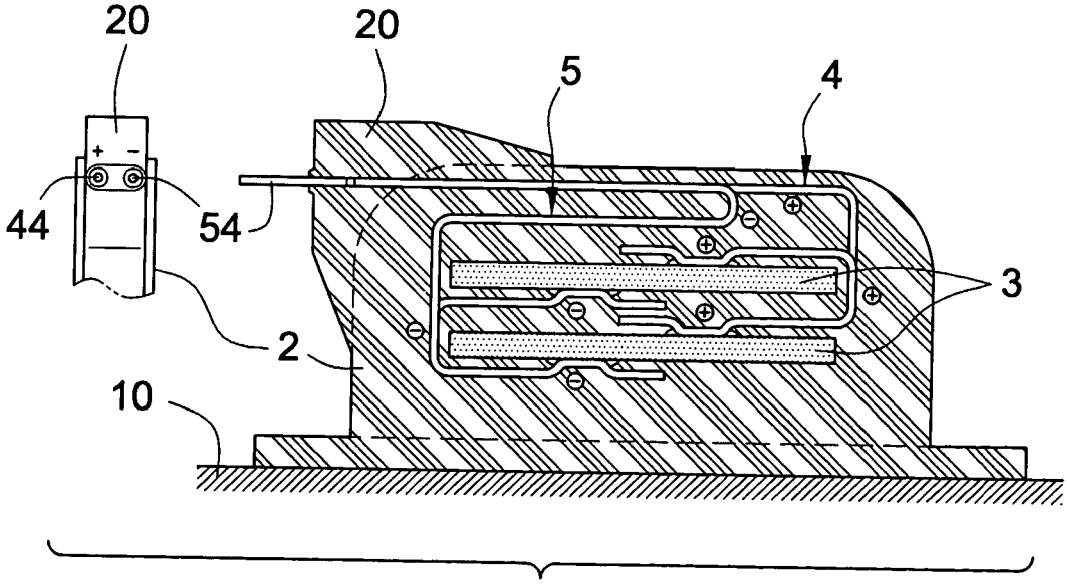
FIG. 5 is a cross sectional view showing that conductive elements of the present invention protrude from the stub.

Furthermore, the stub 2 of the present invention can be extended with a protruding seat 20 (referring to FIG. 5) and the external joints 41, 52 of the positive electrode conductive element 4 and the negative electrode conductive element 5 of the stub 2 protrude out of the stub 2 so as to be beneficial for connecting the positive electrode terminal 44 and negative electrode terminal 54 of external sound leads. However, this is within the scope of the present invention.

Figure 6:
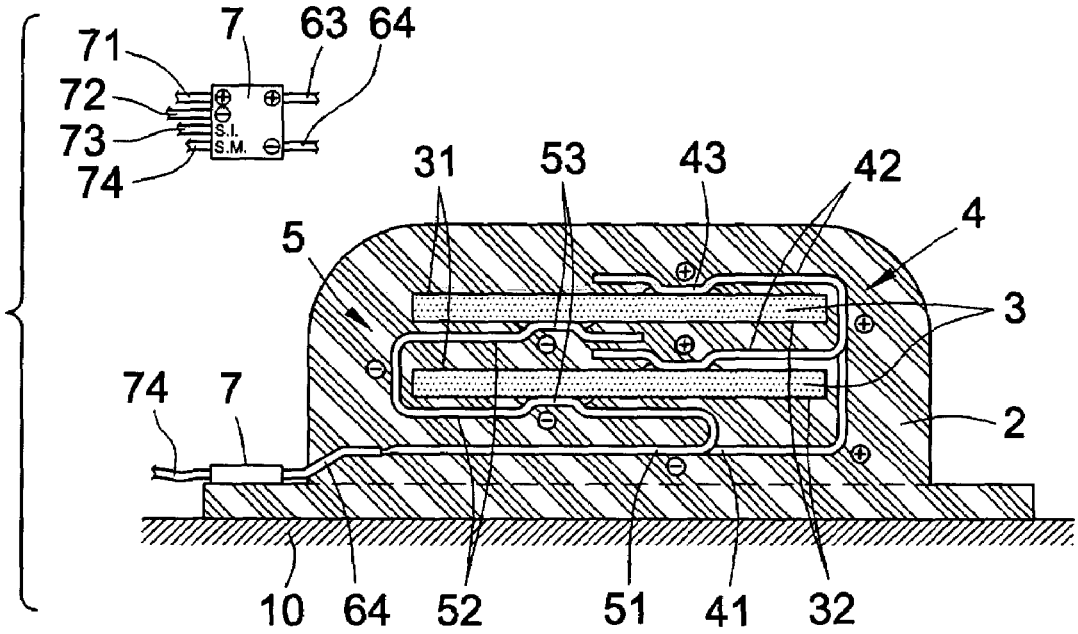
FIG. 6 is a cross sectional view about one embodiment showing that the stub includes a dice.

Besides, in the present invention, the driving circuit of the exciter can be made as a dice 7 to be directly mounted on the stub 2 as an integral body (referring to FIG. 6) so that the present invention can be assembled easily. The driving circuit is formed by an assembled DC converter with an amplifier (AMP) to be as an integrated circuit (IC). The input ports of the dice 7 are installed positive electrode lead 63 and negative electrode lead 64 to be directly packaged and connected to the positive electrode conductive element 4 and negative electrode conductive element 5 of the stub 2. Moreover, the output ports of the dice 7 have a sound source positive electrode port (V+) 71, a sound source negative electrode port (V−) 72, a signal input port 73 and a standby port 74, other connectors for being used with other external devices. All above mentioned structures are within the scope of the present invention.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A conductive stub of a sound exciter comprising an insulating stub and at least two beams which are longitudinally or transversally arranged in parallel; each beam being made of piezoelectric material and each beam having a positive electrode surface and an negative electrode surface; the stub being connected with a positive electrode lead and a negative electrode lead for being connected to an external sound source;

a positive electrode conductive element and a negative electrode conductive element being embedded in the stub;

each of the positive electrode conductive element and the negative electrode conductive element having an external joint and a plurality of touch press ends; and the touch press end of the positive electrode conductive element being in contact with a positive electrode surface of each beam and the touch press end of the negative electrode conductive element being in contact with the negative electrode surface of each beam; wherein sound signals are transferred to each beam to excite the beams to oscillate and then emits sound.

2. The conductive stub of a sound exciter as claimed in claim 1, wherein the positive electrode conductive element and the negative electrode conductive element are made of copper or other conductive metal.

3. The conductive stub of a sound exciter as claimed in claim 1, wherein external joints of the positive electrode conductive element and the negative electrode conductive element protrude out of the stub for being connected to the positive electrode terminal and negative electrode terminal of sound signal leads.

4. The conductive stub of a sound exciter as claimed in claim 3, wherein the stub is extended with a protruding seat for mounting the positive electrode terminal and the negative electrode terminal protruding from stub.

5. The conductive stub of a sound exciter as claimed in claim 1, wherein one end of each of the positive electrode lead and the negative electrode lead are embedded in the stub.

6. The conductive stub of a sound exciter as claimed in claim 5, wherein another end of each of the positive electrode lead and the negative electrode lead are connected to a connector; the connector having a positive electrode inserting hole and a negative electrode inserting hole or pin.

7. The conductive stub of a sound exciter as claimed in claim 1, wherein the touch press ends of the positive and the negative electrode conductive elements are formed with a touch press portion having a protruded cambered shape or a tip shape so that the touch press end or the touch press portion directly contacts with the positive and the negative electrode surface, respectively, of the beam.

8. The conductive stub of a sound exciter as claimed in claim 1, wherein a driving circuit used for the sound exciter is made as a dice, the dice is mounted on the stub; and the driving circuit is formed by an Integrated circuit containing a DC converter and an amplifier.

9. The conductive stub of a sound exciter as claimed in claim 8, wherein input ports of the dice are installed to the positive electrode lead and to the negative electrode lead to be directly packaged and connected to the positive electrode conductive element and to the negative electrode conductive element of the stub; the output ports of the dice include at least one of a sound source positive electrode port, a sound source negative electrode port, a signal input port, a standby port, and ports for connectors for being used with other external devices.

* * * * *